United States Patent [19]

Wrenn, Jr. et al.

[11] 3,938,353

[45] Feb. 17, 1976

[54] LIQUID TRAPPING SUCTION ACCUMULATOR

[75] Inventors: George T. Wrenn, Jr., Crittenden; Hugh W. Mann, Portsmouth; Krishna R. K. Sarma, Chesapeake, all of Va.

[73] Assignee: Virginia Chemicals, Inc., Portsmouth, Va.

[22] Filed: Dec. 12, 1974

[21] Appl. No.: 532,106

Related U.S. Application Data

[63] Continuation-in-part of Ser. No. 359,569, May 11, 1973, abandoned.

[52] U.S. Cl. ..... 62/503

[51] Int. Cl.[2] ..... F25B 43/00

[58] Field of Search ..... 62/503

[56] References Cited

UNITED STATES PATENTS

| | | | |
|---|---|---|---|
| 2,953,906 | 9/1960 | Quick | 62/503 |
| 3,212,289 | 10/1965 | Bottum | 62/503 |
| 3,488,678 | 1/1970 | Wagner | 62/503 |
| 3,563,053 | 2/1971 | Bottum | 62/503 |
| 3,698,207 | 10/1972 | Melnyk | 62/503 |
| 3,754,409 | 8/1973 | Wrenn, Jr. et al. | 62/503 |

*Primary Examiner*—William F. O'Dea
*Assistant Examiner*—Ronald C. Capossel

[57] ABSTRACT

An improved liquid trapping suction accumulator of the type used intermediate the compressor and evaporator in a vapor-compression refrigeration system as a protective device for the compressor. The device provides for minimal pressure drop in the system while still performing the function of compressor protection, and provides for safe removal without "slugging" of accumulated oil and/or liquid refrigerants from the accumulator chamber. The structure is characterized by J-shaped tube mounted within the accumulator with a bent short leg extending above the accumulator bottom; also, by a cylindrical interference jib of the J-shaped within the accumulator outlet, so as to control the size of the vent.

4 Claims, 6 Drawing Figures

LIQUID TRAPPING SUCTION ACCUMULATOR

CROSS REFERENCE TO RELATED APPLICATIONS:

1. A continuation-in-part of applicants' earlier filed IMPROVED LIQUID SUCTION ACCUMULATOR (Ser. No. 359,569), filed May 11, 1973 now abandoned.

2. LIQUID TRAPPING SUCTION ACCUMULATOR (Application Ser. No. 232,110 Filed Mar. 6, 1972, now U.S. Pat. No. 3,754,409)

BACKGROUND OF THE INVENTION

Conventionally, a suction accumulator is an enclosed chamber, located between the evaporator and the compressor in a vapor-compression refrigeration system, used as a protective device for the compressor. However, quite often liquid refrigerant and oil is entrained in the return gas, and the presence of large enough quanties of such returning as slugs to the compressor could result in severe damage to this vital system component. Also, after such conditions as defrost or long-duration shutdown, condensed liquid refrigerant can often suddenly surge towards the compressor on startup. Such large volumes of liquid refrigerant or oil, if introduced into the compression chamber of positive displacement type compressors, due to its relative incompressibility, can result in so-called compressor slugging which can lead to severe damage to reeds or valves, pistons, and connecting rods. If the liquid is primarily condensed refrigerant, dilution of the lubricating oil can result, due to the high solubility of the oil in the liquid refrigerant, which can severely reduce the lubrication of the bearings and moving surfaces also cause compressor failure. Suction accumulators have been designed to prevent, or at least minimize, compressor failures such as these. Previous accumulator designs have provided for elaborate means of baffling, directing inlet gas/liquid flow away from the outlet gas flow stream in order to prevent the liquid entrapped in the gas stream from proceeding directly downstream to the compressor with the return gas, and the like. Such previous accumulator designs had an inherent low efficiency with respect to the pressure drop across the device. Since pressure drop across any component in the suction line of a refrigeration system has an adverse effect on the total system capacity and total pressure loss must be minimized.

An ideal accumulator should prevent slugging and at the same time should not cause burn-out by returning the oil to the compressor. In addition to these two functions, an ideal accumulator should offer as little resistance to flow, i.e., pressure drop, as possible and perform satisfactorily even at very low temperatures such as normally encountered in refrigeration systems of the type contemplated.

A solution to these basic problems has been devised and is shown in aforementioned U.S. Pat. No. 3,754,409 and is based on the idea of diverting the two phase flow entering the accumulator from the path of the flow leaving the accumulator. During this diversion, the liquid part falls below due to the action of gravity and the vapors, only vapors, leave the accumulator to enter the suction side of the compressor. As shown in U.S. Pat. No 3,754,409, this is accomplished by means of a J-tube of a certain configuration and arrangement and which also includes oil return and no flooding conditions by means of an orifice incorporated at the bottom of the J.

The present invention constitutes an improvement over the previous accumulators and that shown in the aforementioned patent, as well as the parent application.

THE PRIOR ART

WRENN et al U.S. Pat. No. 3,754,409

QUICK U.S. Pat. No. 2,953,906

Quick's J-tube extends above inlet port 22, hence the gaseous flow changes direction twice, i.e. (1) from the bottom of the chamber to the top and (2) from the top of the chamber towards J-tube inlet 27 with consequent, immense pressure drops.

SUMMARY OF THE INVENTION

The present invention discloses a liquid trapping suction accumulator for disposition in a compression refrigeration system intermediate the compressor and evaporator and which functions in an improved manner as a protective device for the compressor. The arrangement of parts is such that there is a minimal pressure drop in the system while avoiding slugging and still insuring compressor protection. The present invention provides additional insurance against the possibility of excessive liquid leaving the accumulator and reaching the compressor in damaging quantities when the system starts up and/or operates with high liquid levels in the accumulator. The configuration and dimensions of the J-tube have been changed and provided a slight bend in the inlet side of the tube to prevent alignment of the tube inlet with the accumulator inlet. This change provides better liquid separation capabilities for the accumulator when operating under some conditions. The effected changes have not adversely effected the pressure drop through the accumulator significantly.

Additional objects and advantages of the invention will be more readily apparent from the following detailed description of an embodiment thereof when taken together with the accompanying drawings in which.

Figure 1:
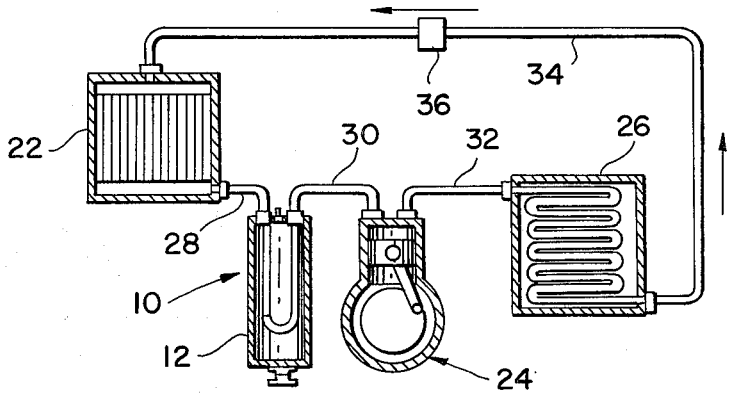
FIG. 1 is a schematic view of a liquid refrigeration system.

Referring now in more detail to the drawings, FIG. 1 schematically shows a liquid refrigeration system of a type incorporating the liquid trapping suction accumulator of the invention. The accumulator 10 includes a cylindrical housing 12 having a top closure 14 and a bottom closure 16. An inlet generally designated 18, and an outlet generally designated 20, are provided for appropriate connection into the system shown in FIG. 1. The system, as is usual in this type, includes an evaporator 22 and a compressor 24 with the accumulator 10 being positioned intermediate therebetween. The system also includes condenser 26. Inlet 18 is fed by conduit 28 extending from evaporator 22. Conduit 30 extends between accumulator 10 and compressor 24, and conduit 32 extends between compressor 24 and condenser 26. A further conduit 34 interconnects condenser 26 and evaporator 22. As schematically indicated at 36, an expansion device or restriction can be incorporated in conduit 34 between the condenser outlet and the evaporator inlet. Flow directions are indicated by arrows in FIG. 1.

The new accumulator design, as shown in FIGS. 2–6, consists of the top closure 14 into which is incorporated inlet 18 and outlet 20 connections, and a mounting stud 38 for use with possible brackets and a removable thread protector 40. Removable plug seals 42 and 44 are provided for inlet and outlet members 18 and 20 and can consist of a resilient plastic or the like. Internally of the cylindrical housing 12, there is a generally J-shaped tube or unbalanced U-shaped tube 46 mounted by means of a bottom bracket 48.

Figure 3:
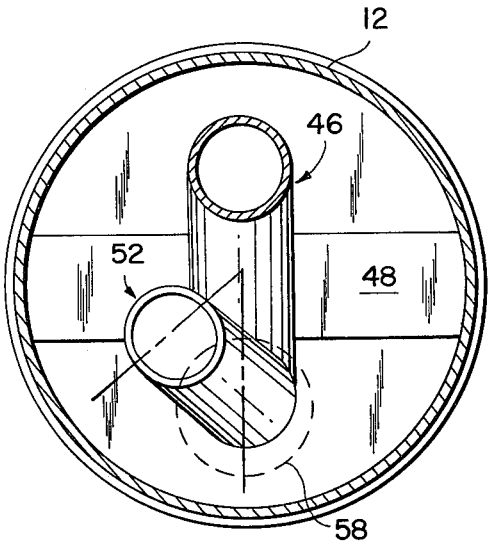
FIG. 3 is an enlarged sectional view taken on line 3—3 of FIG. 2.
Figure 4:
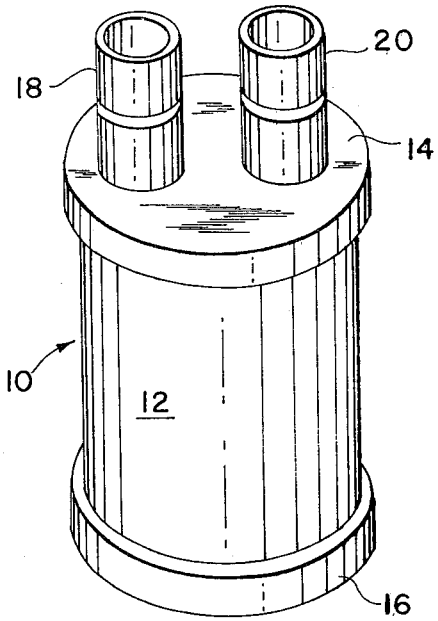
FIG. 4 is a perspective view of the exterior of the suction accumulator.
Figure 5:
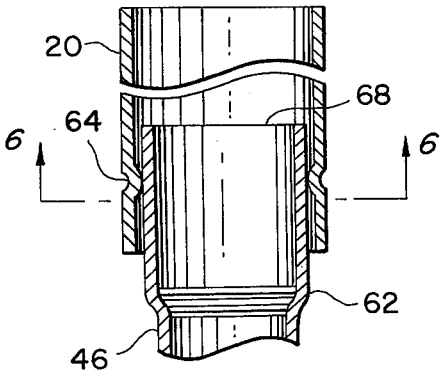
FIG. 5 is a fragmentary enlarged sectional view showing joinder of a J-tube outlet used in the invention with an outlet connector from the accumulator.
Figure 6:
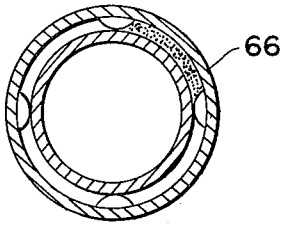
FIG. 6 is a sectional view taken on line 5—5 of FIG. 6.

The long leg of J-shaped tube 46 is at its upper end 62 provided with an enlargement 62 or the like inserted in outlet 20 by means of an interference jib, as illustrated in FIGS. 5 and 6 and providing an annulus 66 for the exiting of gas. The shorter leg 52 of the J-shaped tube 46 extends upwardly from the bottom bend 54 in which there is a small bleed hole 56 which is provided for controlling the return of small amounts of oil and/or liquid refrigerant. The illustrated positioning of the J-tube inlet with respect to the inlet fitting provides minimal pressure drop while still performing the function of compressor protection. This is governed by the extended length of the short arm 52 with respect to the overall length of the accumulator and with respect to the distance from the bottom of the tube and the spacial distance from the inlet. With respect to the J-tube shown in the aforementioned patent, the short leg 52 in the present device has been extended considerably. This provides additional insurance against the possibility of excessive liquid leaving the accumulator and reaching the compressor in damaging quantities when the system starts up and/or operates with high liquid levels in the accumulator. Additionally, a slight bend as indicated at 58 has been made in the inlet side or short leg of the J-tube to prevent exact alignment of the tube inlet 60 with the accumulator inlet 18. This can be a simple bend or otherwise to offset the two sections of the tube and provides better liquid separation capabilities for the accumulator when operating under some conditions. Tests have indicated that these changes over the prior art have not adversely affected the pressure drop through the accumulator. In one preferred embodiment the inlet opening of the J-tube is offset from the inlet entrance to the accumulator by about 90°. As illustrated in FIG. 3, the angular displacement of the distal end of the short leg may be up to 90° without introducing substantial pressure losses. This does not produce any velocity reversals but is more effective in not allowing liquid droplets to enter the J-tube.

If desired, the short arm 58 of the J-tube can be drilled additionally as at 70, 72 and at different distances starting from the bend which will insure returning liquid will be from the upper layer which is the oil-rich phase. The diameters of such holes, if used, may be progressively increasing in diameter toward the open end of the J-tube to make flows from the orifices be approximately equal. Additionally, an escape vent small hole could be drilled just below the neck of the J-tube exit and preferably have a diameter at least equal to the bottommost orifice.

The offset disposition of the short leg 52 is shown with reference to the broken line circle 58 in FIG. 3 which represents an in-line position of the inlet connector.

The length of short leg 52, and accordingly the distance of the inlet opening 60 from the bottom of the accumulator, can be varied. As shown in the drawing, as an example, the short leg extends beyond the vertical middle point of the accumulator, and can be extended, for example, to within a distance of between two to three times the diameter of the inlet connector 18.

Figure 2:
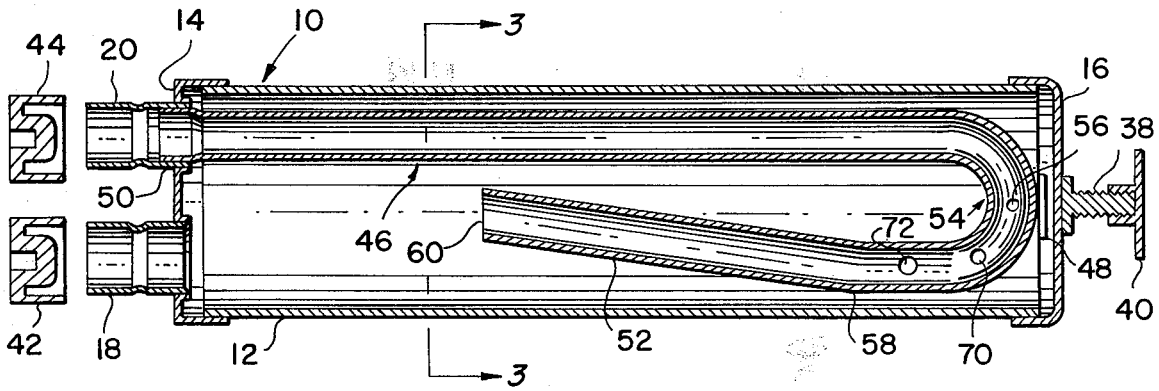
FIG. 2 is an enlarged vertical sectional view of the liquid trapping suction accumulator of the invention.

The invention also concerns itself with the safe removal of the accumulated oil and/or liquid refrigerant from the chamber without slugging. FIGS. 2, 5 and 6 show the typical detail of the J-tube 46 with the liquid feedback port 56 an its outlet connector 20 is staked with 4 "dimples" 64. Four dimples 64 are shown in this case, a minimum of three being necessary to centrally locate the J-tube outlet O.D. within the I.D. of the fitting. As can be seen, the diameter as given by the height of the dimples 64 creates an interference fit with the diameter of the J-tube outlet and 62 when the two are mated as in FIG. 5. This method lends a rigid support to the upper end of the J-tube when mounted within the accumulator. Further, the cross-sectional areas between the O.D. of the tube 62 and the I.D. of the outlet connector 20 and between the dimples 64 provides a region or annulus shown typically by stippling area 66. Annulus 66 provides a predetermined open area for exiting gas as will be explained later.

Once any liquid refrigerant or oil is "sprayed" into the accumulator chamber, the overwhelming majority of the droplets either impinge on the accumulator inner walls and run down the sides, or fall harmlessly to the bottom where the liquid is allowed to build up. If this situation were to continue over a period of time the liquid level would build up to a point just below the liquid feedback port 54. Then, the returning vapor passing through the J-tube causes a low pressure area at the port, due to the relatively high velocity of the returning vapor inside, and liquid is drawn up and through the port and is carried back with the gas. The small opening of 50, as well as ports 70–72 act as a metering orifice to limit the flow of liquid into the J-tube and on to the compressor.

While this port can be designed to safely prevent excess liquid from entering the J-tube while the system is running, it cannot prevent the influx of oil and liquid refrigerant into the J-tube when the system is shut down and no vapor is flowing through the J-tube bend, then sufficient liquid could enter the tube via the port to completely fill the bottom of the J-tube. This situation happens quite often in practice and must be coped with. If the tube were the only means of exit of the gas returning to the compressor, then the full bottom portion of the tube would cause the slug of liquid trapping therein to be returned in one large volume, causing possible damage to the compressor.

Previous accumulator designs have incorporated small vent holes near the top of the oil return tubes to allow bypassing of the gas when the oil return tube was blocked off or sealed by the liquid level as explained above. The reason for this is that during a prolonged shutdown, during which time the refrigerant is susceptible to condensing and collecting in the accumulator chamber, pressure equalization occurs throughout the system, which causes the relatively high saturation pressure of the refrigerant to build up on the suction side, including within the accumulator. Immediately upon restart of the compressor, the suction lines begin to be pumped down to a pressure considerably lower than before restart. With liquid entrapped within the oil return tube, the pressure upstream of the accumulator remains essentially the same (high) while downstream pressure becomes quite reduced. With no internally communicating vent hole between the inlet and outlet connections, the high pressure behind the liquid slug can force this fluid out in one large volume toward the compressor. A conventional vent hole provides communication between the high pressure upstream side and the low pressure downstream piping and permits the high pressure gas to temporarily bypass the oil return tube until the upstream pressure is also reduced by the pumping action of the compressor. Some previous designs do not allow sufficient quantities of gas to vent under some conditions to equalize the upstream and downstream pressures. This results in a portion of the liquid within the tube being forced downstream in order to provide temporary escape for more of the high pressure gas.

The method of attaching the J-tube to the outlet connector, as shown in FIG. 5 allows a unique arrangement for controlling the size of the vent, depending of the design parameters. To insure proper venting, the bypass cross-sectional area 66 should be within 5 to 50% of the total cross-sectional area of the suction line piping, the actual area dependent on many variable operating conditions. It should be noted here that a number of methods of construction of a suitable "vent" cross-sectional area can be employed, but one of the unique features is that this design can provide the proper vent with minimal obstruction to gas flow, both during venting and, more important, during normal operation to minimize pressure drop. The area can, of course, be controlled to the desired optimum condition by proper sizing of the J-tube outlet diameter 62, with respect to the connector 20 inside cross-sectional area, and the height of the dimples, or staking, used.

Still another feature of this outlet connector arrangement is that it provides a streamlined section that creates a venturi action as mentioned for example in W. O. Krause U.S. Pat. No. 3,483,714, at the outlet connection. This venturi action is created as the refrigerant vapor flowing through the accumulator accelerates celerates through the region of reduced cross section, shown at stippled area 66. This high velocity existing gas creates an area of low pressure at the J-tube outlet 68 which helps to vaporize any refrigerant liquid within the tube, as well as tends to help remove the oil/liquid refrigerant by a "pumping" action forcing the liquid up the tube. The streamlining of this venturi creates a more efficient pump, with inherent reduced kinetic energy loss, and therefore less system capacity loss. The proper venturi action is likewise dependent on the cross-sectional area through which the exiting vapor must pass. Therefore, proper sizing of the venturi throat is also necessary. Again, this can be controlled by the method of construction of the outlet connector and J-tube sizing. Therefore, it can be seen that optimization is necessary, and with this construction method optimization between the venturi throat sizing and high pressure bypass vent can be achieved very easily for any given condition.

The herein described accumulator has been extensively tested under many and severe conditions. The testing revealed that the design results in a pressure drop loss of less than half that of the best accumulator currently available on the market. Oil return tests under all conditions were good. Liquid fill tests, where liquid refrigerant is allowed to build up inside the chamber to various levels prior to restarting the accumulator, have been conducted with the vessels as much as 80% full of liquid refrigerant, the J-tube inlet 56 being well below the liquid level, and restarting the compressor caused no slugging at all.

Manifestly minor changes in details of construction can be effected within the scope and purview of the invention without departing from the spirit and scope of the invention as defined in and limited solely by the appended claims.

We claim:

1. A liquid trapping suction accumulator adapted for insertion in a vapor-compression refrigeration system between the evaporator and compressor, comprising:

A. an accumulator chamber defined by a casing having a top and a bottom;

B. inlet and outlet ports in said opening into said chamber and respectively adapted for operative connection to said evaporator and said compressor; and C. an outlet connector mounted in said outlet port;

D. a J-shaped tube mounted within said casing; and i. the long leg thereof extending into and terminating in said outlet connector centrally positioned within and in peripherally spaced relationship from the internal surface of said outlet port;

ii. inwardly extending dimples spacedly positioned about the inner periphery of said outlet connector and providing an interference fit with the outer diameter of said J-tube outlet end for rigid support thereof in said connector, the spacing between the dimples creating a predetermined open area therebetween for exiting gas;

iii. the outlet end of said J-tube being outwardly flared to a controlled diameter for coacting with said dimples in an interference fit therewith; and iv. a short inlet leg thereof extending a substantial distance above the chamber bottom, and said short leg having a bend therein angularly displacing the inlet opening from direct vertical alignment with said inlet port, wherein the distal end of said short leg extends above the vertical midpoint of said accumulator chamber, distal short leg further including a liquid feedback port at the bend of said J-tube with a plurality of additional liquid feedback orifices of increasing diameter in said short leg, said orifices being of increasing diameter towards said distal end.

2. A liquid trapping suction accumulator as claimed in claim 1, said short inlet leg being extended vertically in said chamber to within a distance of between two to three times the diameter of said inlet port.

3. A liquid trapping suction accumulator as claimed in claim 1, said short inlet leg being bent to offset said inlet opening approximately 90° from said inlet port into said chamber.

4. A liquid trapping suction accumulator as claimed in claim 1, wherein said predetermined open area for exiting gas is within 5 to 50 percent of the inner diameter of said J-tube outlet.

* * * * *

UNITED STATES PATENT OFFICE
CERTIFICATE OF CORRECTION

Patent No. 3,938,353 Dated February 17, 1976

Inventor(s) George T. Wrenn et al

It is certified that error appears in the above-identified patent and that said Letters Patent are hereby corrected as shown below:

Column 1, line 21 - "quanties" should be -- quantities --.

Column 5, line 47 - delete "celerates".

Column 5, line 48 - "existing" should be -- exiting --.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*